US006891462B2

(12) United States Patent
Andoh et al.

(10) Patent No.: US 6,891,462 B2
(45) Date of Patent: May 10, 2005

(54) HIGH-Q INDUCTOR FOR HIGH FREQUENCY

(75) Inventors: Toshiakira Andoh, Katano (JP); Makoto Sakakura, Uji (JP); Toshifumi Nakatani, Moriguchi (JP); Kouji Takinami, Katano (JP); Yukio Hiraoka, Nishinomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/667,386

(22) Filed: Sep. 23, 2003

(65) Prior Publication Data

US 2004/0041680 A1 Mar. 4, 2004

Related U.S. Application Data

(62) Division of application No. 10/043,222, filed on Jan. 14, 2002, now Pat. No. 6,664,882, which is a division of application No. 09/454,610, filed on Dec. 7, 1999, now abandoned.

(30) Foreign Application Priority Data

Dec. 11, 1998 (JP) ..... H10-353078

(51) Int. Cl.[7] ..... H01F 5/00
(52) U.S. Cl. ..... 336/200; 336/232; 336/223
(58) Field of Search ..... 336/200, 232, 336/223

(56) References Cited

U.S. PATENT DOCUMENTS

| | | | | |
|---|---|---|---|---|
| 3,798,059 A | | 3/1974 | Astle et al. | |
| 4,494,100 A | | 1/1985 | Stengel et al. | |
| 4,583,099 A | | 4/1986 | Reilly et al. | |
| 4,626,816 A | * | 12/1986 | Blumkin et al. | 336/192 |
| 4,641,118 A | | 2/1987 | Hirose et al. | |
| 5,382,829 A | * | 1/1995 | Inoue | 257/659 |
| 5,398,400 A | * | 3/1995 | Breen | 29/602.1 |
| 5,497,337 A | | 3/1996 | Ponnapalli et al. | |
| 5,656,849 A | | 8/1997 | Burghartz et al. | |
| 6,037,649 A | | 3/2000 | Liou | |
| 6,136,458 A | | 10/2000 | Inoue | |
| 6,268,778 B1 | | 7/2001 | Mucke et al. | |
| 6,355,535 B2 | | 3/2002 | Liou | |
| 6,366,192 B2 | * | 4/2002 | Person et al. | 336/200 |
| 6,426,267 B2 | | 7/2002 | Liou | |

FOREIGN PATENT DOCUMENTS

| | | | |
|---|---|---|---|
| EP | 0484558 | 12/1991 | |
| JP | 409270332 A | 1/1997 | |
| WO | WO 91/19303 | 12/1991 | |
| WO | WO 9119303 A1 * | 12/1991 | H01F/17/00 |

OTHER PUBLICATIONS

Article Entitled "Design and Simulation of Film Transformer on Flexible Polyamide Film in Very High Frequency Range" by H. Tsujimoto, IEEE Transaction on Magnetics, vol. No. 4, Jul. 1998.

H. Tsujimoto, "Design and Simulation of Film Transformer on Flexible Polyamide Film in Very High Frequency Range", IEEE Transactions on Magnetics, vol. 34, No. 4, Jul. 1998, pp. 1357–1359.

* cited by examiner

*Primary Examiner*—Anh Mai
(74) *Attorney, Agent, or Firm*—Smith, Gambrell & Russell, LLP

(57) ABSTRACT

A high-Q inductor for high frequency, having a plurality of inductor elements formed in a plurality of IC wiring layers with a connection formed therebetween. The directions of the magnetic fields generated by the respective inductor elements are substantially the same. With this construction, the section of the inductor is increased reducing the serial resistance component and an influence of a skin effect in a high-frequency range is eliminated increasing the Q value.

1 Claim, 9 Drawing Sheets

(a) Top view of the first layer (b) Top view of the second layer (c) A-A' cross section Fig. 2 (a) Top view of the first layer Fig. 2 (b) Top view of the second layer Fig. 2 (c) Top view of the third layer Fig. 2 (d) A-A' cross section Fig. 3 (a) Top view of the first layer Fig. 3 (b) Top view of the second layer Fig. 3 (c) A-A' cross section Fig. 3 (d) B-B' cross section Fig. 3 (e) C-C' cross section Fig. 4 (a) Top view of the first layer Fig. 4 (b) Top view of the second layer Fig. 4 (c) Top view of the third layer Fig. 4 (d) Top view of the fourth layer Fig. 4 (e) A-A' cross section Improvement in Q value Variation of R with respect to L Variation of Q with respect to L (a) Top view (b)
A-A' cross section

HIGH-Q INDUCTOR FOR HIGH FREQUENCY

CROSS REFERENCE TO RELATED APPLICATION

This application is a divisional of Ser. No. 10/043,222, filed Jan 14, 2002, now U.S. Pat. No. 6,664,882, which is a divisional of Ser. No. 09/454,610, filed Dec. 7, 1999, now abandoned, and which are both being incorporated in their entirety herein by reference.

CLAIM FOR PRIORITY

A claim for priority for this application is made under Japanese Application JP H10-353,078.

BACKGROUND OF THE INVENTION

1. Field of the Invention

The present invention relates to an inductor having a high Q value for use in high frequency in a semiconductor integrated circuit (IC).

2. Description of the Related Art

A conventional inductor will be described with reference to FIG. 9. Referring to FIG. 9, the reference numeral 1 denotes an inductor section, 2 denotes a drawing interconnect formed in the first layer, 3 denotes a drawing interconnect formed in the second layer, 5 denotes a connection between the first and second layers, 7 denotes an interlayer film, and 8 denotes a smoothing film.

That is, in the conventional inductor, the inductor section is constructed of a single layer and the second layer is used for the drawing interconnect for connection with other components.

As one of characteristics of an inductor, it is generally known that in order to obtain a large inductance value, the line length of the inductor must be increased.

With the above conventional construction, however, when the line length is increased in order to obtain a large inductance value, the serial resistance component increases due to the resistance of a wiring material constituting the inductor, resulting in lowering the Q value of the inductor.

Further, the increased line length of the inductor tends to increase the size of the entire inductor.

SUMMARY OF THE INVENTION

In view of the above problems, an object of the present invention is to provide an inductor having a high Q value while suppressing the serial resistance from increasing.

Another object of the present invention is to provide an inductor of which size is not increased even when the line length thereof is increased.

A high-Q inductor for high frequency of the first present invention is such inductor that one inductor has a plurality of inductor elements formed in a plurality of IC wiring layers respectively; and the directions of magnetic fields generated by the respective inductor elements are substantially the same.

A high-Q inductor for high frequency of the second present invention according to the first present invention, is such inductor that the plurality of inductor elements are connected in series.

A high-Q inductor for high frequency of the third present invention according to the first present invention is such inductor that the plurality of inductor elements are connected in parallel.

A high-Q inductor for high frequency of the fourth present invention according to the first present invention, is such inductor that the plurality of inductor elements include a serial-connected circuit portion and a parallel-connected circuit portion.

A high-Q inductor for high frequency of the fifth present invention according to the first present invention, is such inductor that at least one of the inductor elements is in a meander shape or a spiral shape.

A high-Q inductor for high frequency of the sixth present invention according to any one of the first to fifth present inventions, is such inductor that a connection between the plurality of inductor elements is formed in an interlayer film disposed between the IC wiring layers in which the inductor elements are formed.

A high-Q inductor for high frequency of the seventh present invention according to the first present invention is such inductor that a drawing interconnect from the inductor element is formed in the IC wiring layer in which one of the inductor elements is formed.

The seventh present invention corresponds to FIG. 1.

A high-Q inductor for high frequency of the eighth present invention according to the seventh present invention is such inductor that the plurality of inductor elements are in a spiral shape respectively and connected in parallel with each other, and one of the drawing interconnect is connected to a spiral center of the inductor element and drawn externally by being formed in one of the IC wiring layers, and the spiral-shaped inductor element formed in the IC wiring layer used for the external drawing is cut off at positions where the drawing interconnect crosses, and cut-off ends of the inductor element are connected with each other by being connected with respective corresponding portions of the spiral-shaped inductor element formed in another one of the IC wiring layers.

The eighth present invention corresponds to FIG. 3.

A high-Q inductor for high frequency of the ninth present invention according to any one of the first to sixth present inventions is such inductor that a drawing interconnect from the inductor element is formed in a wiring layer which is different from the IC wiring layers in which the inductor elements are formed.

The ninth present invention corresponds to FIG. 2.

A high-Q inductor for high frequency of the tenth present invention according to the ninth present invention, is such inductor that a drawing interconnect and the inductor element to be connected with the drawing interconnect are connected via an connection formed in an interlayer film disposed between a wiring layer in which the drawing interconnect is formed and the IC wiring layer in which the inductor element is formed.

The tenth present invention corresponds to FIG. 2.

A high-Q inductor for high frequency of the eleventh present invention according to the first present invention, is such inductor that the plurality of inductor elements are in a spiral shape respectively, adjacent inductor elements of the plurality of inductor elements are connected with each other in such manner that the adjacent inductor elements are serially connected by connecting the spiral centers thereof with each other and outer ends thereof with each other, spiral directions of the adjacent inductor elements are in reverse from each other, and directions of the magnetic fields generated by the respective inductor elements are substantially the same.

The eleventh present invention corresponds to FIG. 4 and FIG. 5.

A high-Q inductor for high frequency of the twelfth present invention according to the first present invention, is such inductor that the plurality of inductor elements are in a spiral shape respectively, the plurality of inductor elements are alternately connected with each another in such manner that the inductor elements are serially connected by connecting the centers thereof with each other and outer ends thereof with each other, the spiral directions of adjacent inductor elements repeats the same and the reverse in order, and the directions of the magnetic fields generated by the respective inductor elements are substantially the same.

The twelfth present invention corresponds to FIG. 6

DESCRIPTION OF THE PREFERRED EMBODIMENTS

Embodiments of the present invention will be described with reference to the relevant drawings.

(Embodiment 1)

Figure 1:
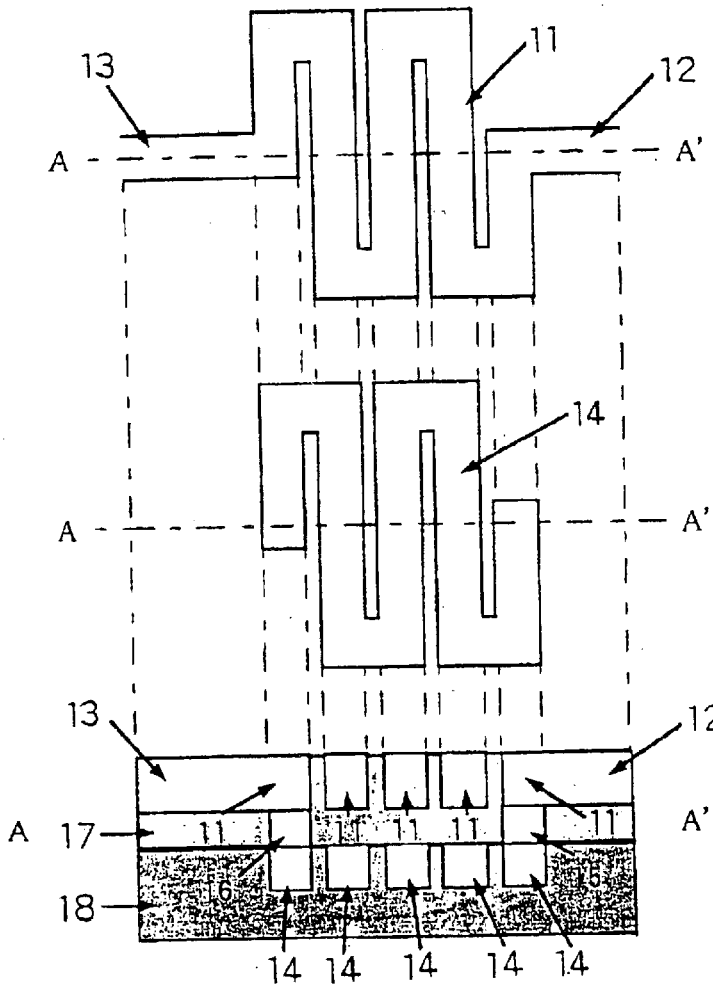
FIG. 1 shows an inductor of Embodiment 1 of the present invention, illustrating a top view of the first and second layers and an I–I' cross-section, respectively, as FIGS. 1(*a*), 1(*b*) and 1(*c*)

FIG. 1 shows the first embodiment of the high-Q inductor for high frequency according to the present invention. Referring to FIG. 1, the reference numeral 11 denotes a meander-type first-layer inductor section (the "inductor section" as used herein corresponds to an "inductor element" to be recited in the claims), 12 and 13 denote first-layer drawing interconnects, 14 denotes a second-layer inductor section, 15 and 16 denote connections between the first and second layers, 17 denotes an interlayer film, and 18 denotes a smoothing film.

Each of the connections 15 and 16 is composed of nine contact portions each having a size of about 1 $\mu$m square, for example.

In this embodiment, therefore, the inductor section, which is conventionally constructed using only one layer, is of a two-layer structure where two inductor sections are formed in the first and second layers and connected in parallel with each other.

The above construction makes it possible to obtain a high Q-value inductor for high frequency which overcomes the conventional problem of having a large serial resistance component in low frequency and high frequency and thus a lowered Q value, by increasing the cross section and suppressing lowering of the Q value which otherwise occurs due to a skin effect in high frequency.

It should be noted that the first and second layers may be connected in parallel over the entire inductor sections. This construction is also included in the present invention.

(Embodiment 2)

Figure 2:
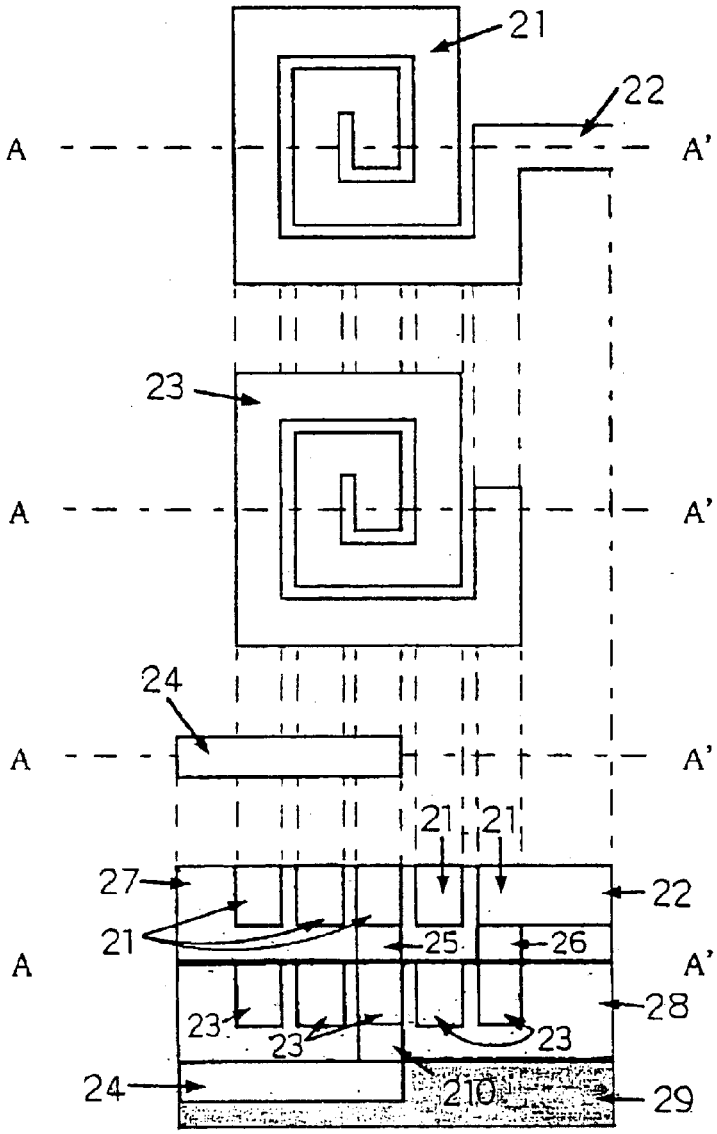
FIG. 2 shows an inductor of Embodiment 2 of the present invention, illustrating a top view of the first, second and third layers and an I–I' cross-section, respectively, as FIGS. 2(*a*), 2(*b*), 2(*c*) and 2(*d*)

FIG. 2 shows the second embodiment of the high-Q inductor for high frequency according to the present invention. Referring to FIG. 2, the reference numeral 21 denotes a spiral-shaped first-layer inductor section, 22 denotes a first-layer drawing interconnect, 23 denotes a spiral-shaped second-layer inductor section, 24 denotes a drawing interconnect from the second-layer inductor section 23 formed in the third layer, 25 and 26 denote connections between the first and second layers, 27 and 28 denote interlayer films, 29 denotes a smoothing film, and 210 denotes a connection between the second and third layers. The first-layer inductor section 22 and the second-layer inductor section 23 are spiraled in the same direction.

In this embodiment, therefore, the inductor section, which is conventionally constructed using only one layer, is of a two-layer structure where the inductor sections 22 and 23 are respectively formed in the first and second layers and connected in parallel with each other. This construction makes it possible to obtain a high Q-value inductor for high frequency which overcomes the conventional problem of having a large serial resistance component in low frequency and high frequency and thus a lowered Q value, by increasing the cross section and suppressing lowering of the Q value which otherwise occurs due to a skin effect in high frequency.

It should be noted that the first and second layers may be connected in parallel over the entire inductor sections. This construction is also included in the present invention.

In this embodiment, the three-layer inductor was exemplified. It is also possible to construct a similar structure composed of four or more layers with a drawing interconnect being formed in the bottom layer.

(embodiment 3)

Figure 3:
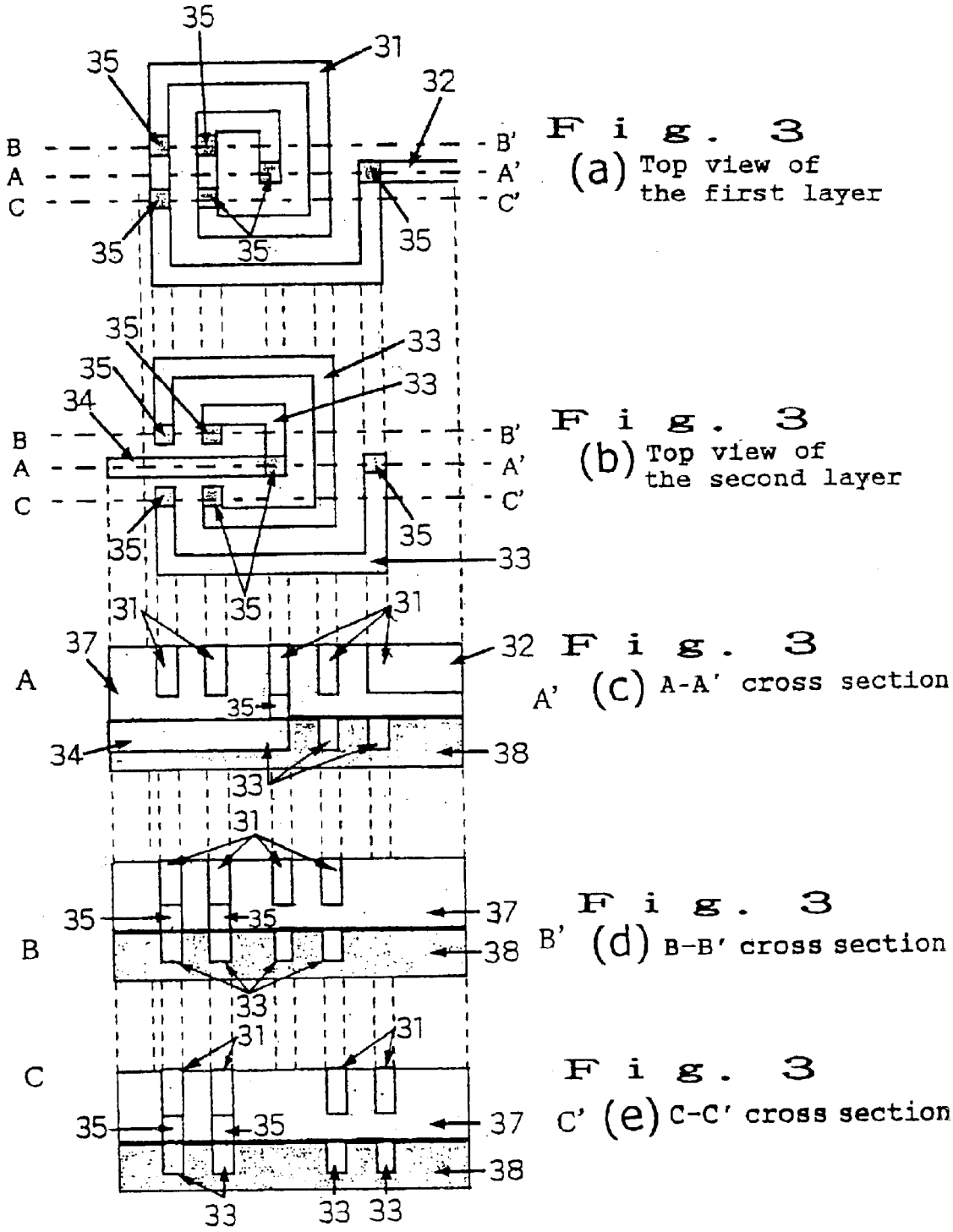
FIG. 3 shows an inductor of Embodiment 3 of the present invention, illustrating a top view of the first and second layers and an I–I', II–II' and III–III' cross-section, respectively, as FIGS. 3(*a*), 3(*b*), 3(*c*), 3(*d*) and 3(*e*)

FIG. 3 shows the third embodiment of the high-Q inductor for high frequency according to the present invention. Referring to FIG. 3, the reference numeral 31 denotes a spiral-shaped first-layer inductor section, 32 denotes a first-layer drawing interconnect, 33 denotes a spiral-shaped second-layer inductor section, 34 denotes a second-layer drawing interconnect, 35 denotes connections between the first and second layers, 37 denotes an interlayer film, and 38 denotes a smoothing film.

The first and second inductor sections 31 and 33 are connected in parallel with each other.

Embodiment 3 is characterized in that the second-layer drawing interconnect 34 is formed using the layer in which the second-layer inductor section 33 is formed. In order to prevent the second-layer inductor section 33 from being in contact with the drawing interconnect 34 in the same layer, the second-layer inductor section 33 is cut off at the positions where the drawing interconnect 34 crosses. The cut-off ends of the inductor section 33 are connected with the first-layer inductor section 31 via the connections 35. By this construction, the second-layer inductor section 33 can serve as one substantially spiral-shaped inductor section.

In this embodiment, therefore, the inductor section, which is conventionally constructed using only one layer, is of a two-layer structure where inductor sections are formed in the first and second layers and connected in parallel with each other. Furthermore, the inductor sections are formed in the layers in which the drawing interconnects are formed. As a result, it is possible, even in a process where a smaller number of wiring layers are used, to obtain a high Q-value inductor for high frequency which overcomes the conventional problem of having a large serial resistance component in low frequency and high frequency and thus a lowered Q value, by increasing the cross section and suppressing lowering of the Q value which otherwise occurs due to a skin effect in high frequency.

Thus, Embodiment 3 is characterized in that one of the drawing interconnects is formed using the wiring layer for the inductor section, which is different from Embodiment 2 where the layer for forming the drawing interconnect is separately provided.

It should be noted that the first and second layers may be connected in parallel over the entire inductor sections. This construction is also included in the present invention.

In this embodiment, the two-layer inductor was exemplified. It is also possible to construct a similar structure composed of three or more layers with a drawing interconnect being formed in any of the layers. In this case, portions of an inductor section at which the drawing interconnect crosses can be connected with an adjacent upper or lower inductor section.

Figure 7:
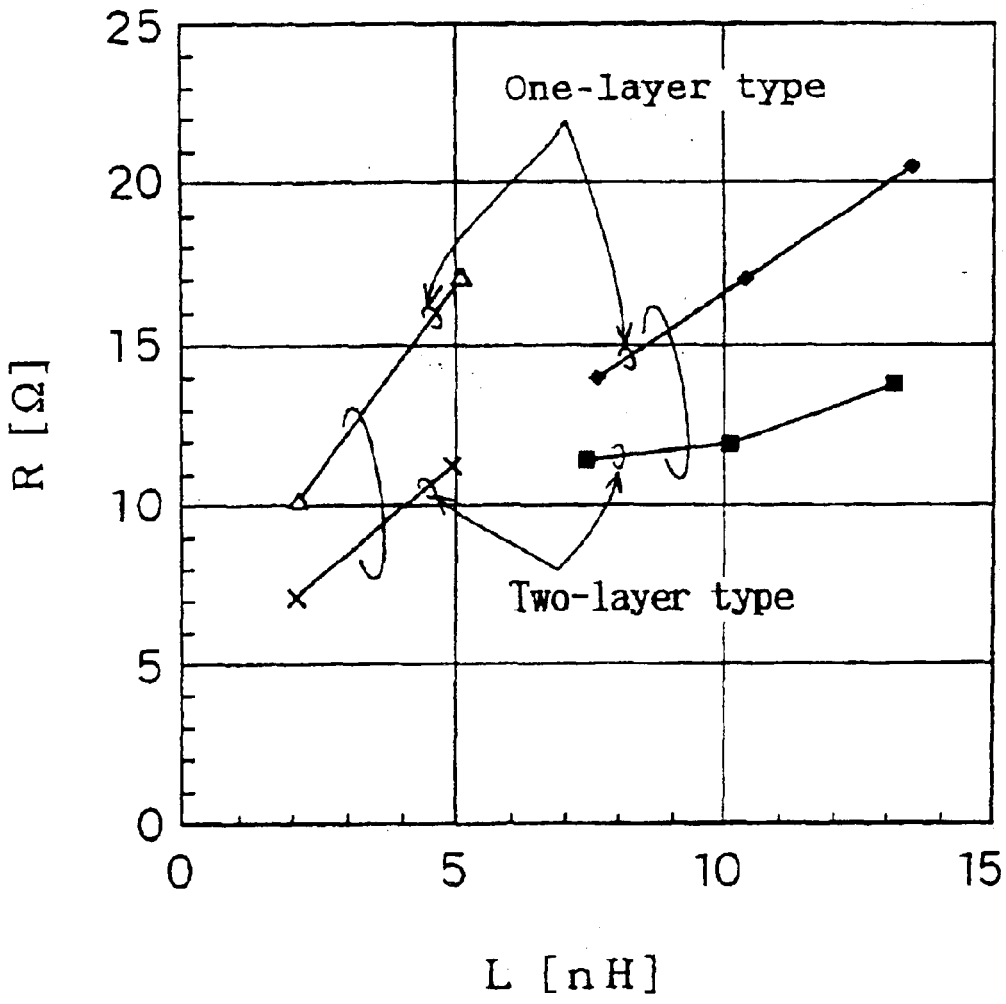
FIG. 7 is a graph showing comparison of the present invention with a conventional inductor.
Figure 8:
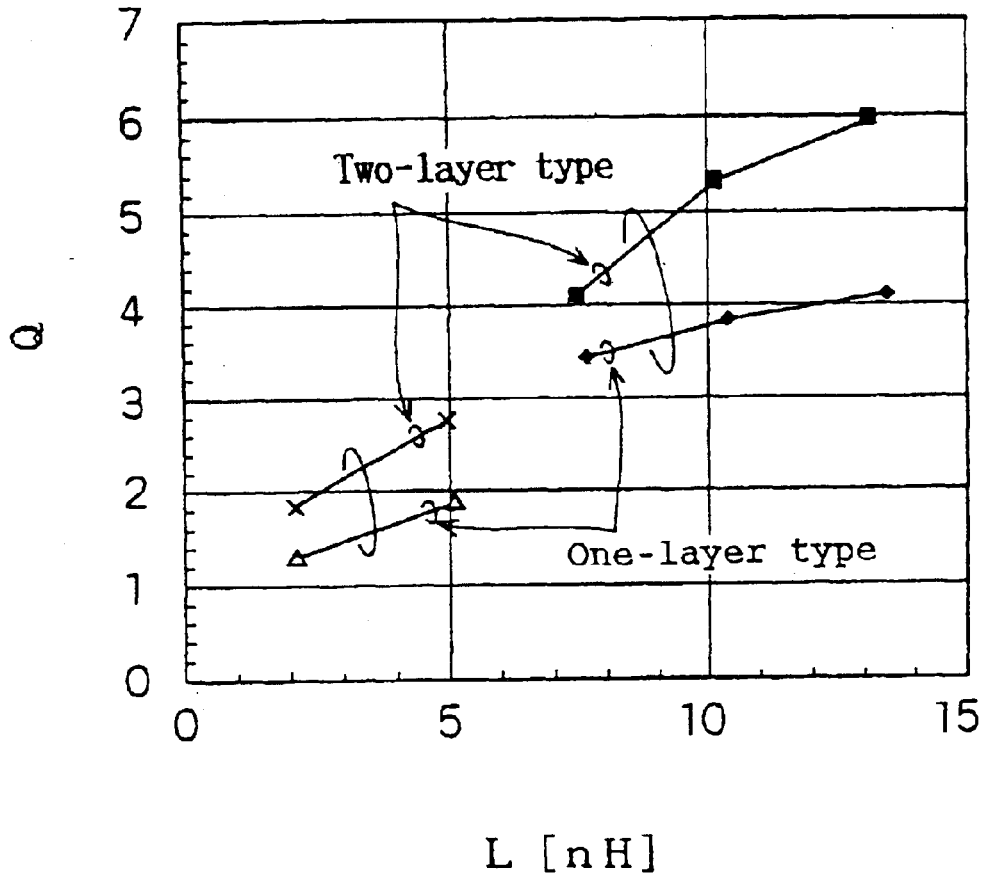
FIG. 8 is another graph showing comparison of the present invention with the conventional inductor.
Figure 9:
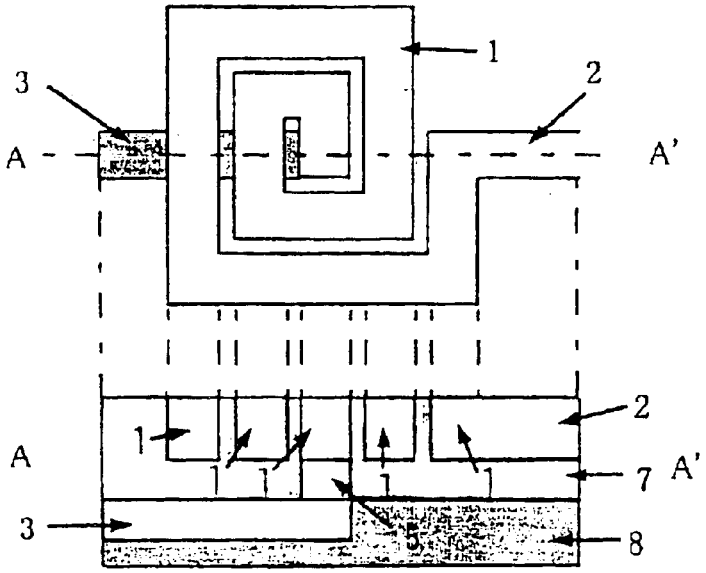
FIG. 9 shows a conventional inductor, illustrating a top view and an I–I' cross-section, respectively, as FIGS. 9(*a*) and 9(*b*).
Figures 1A, 1B, 1C:
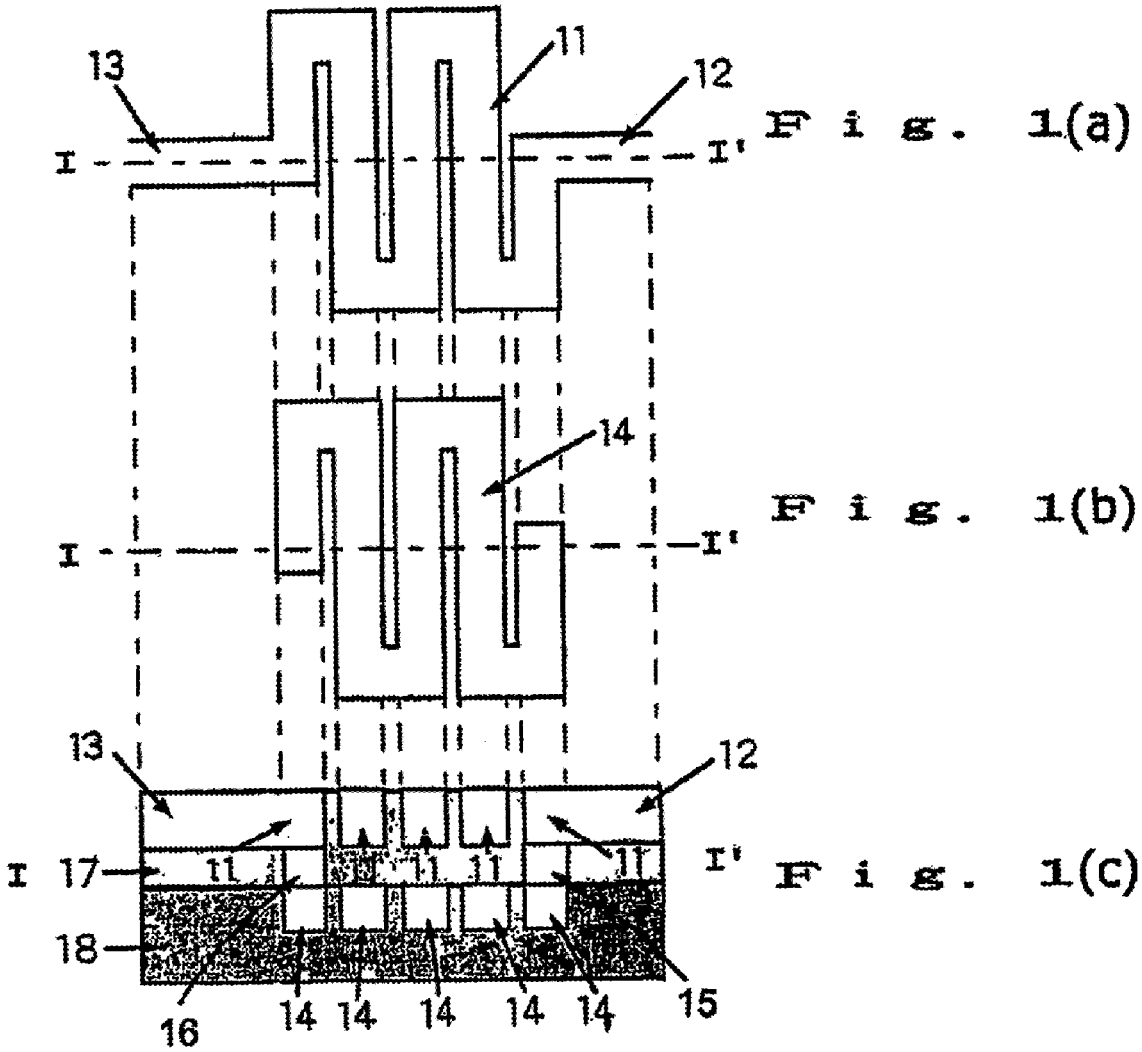
Figures 2A, 2B, 2C, 2D:
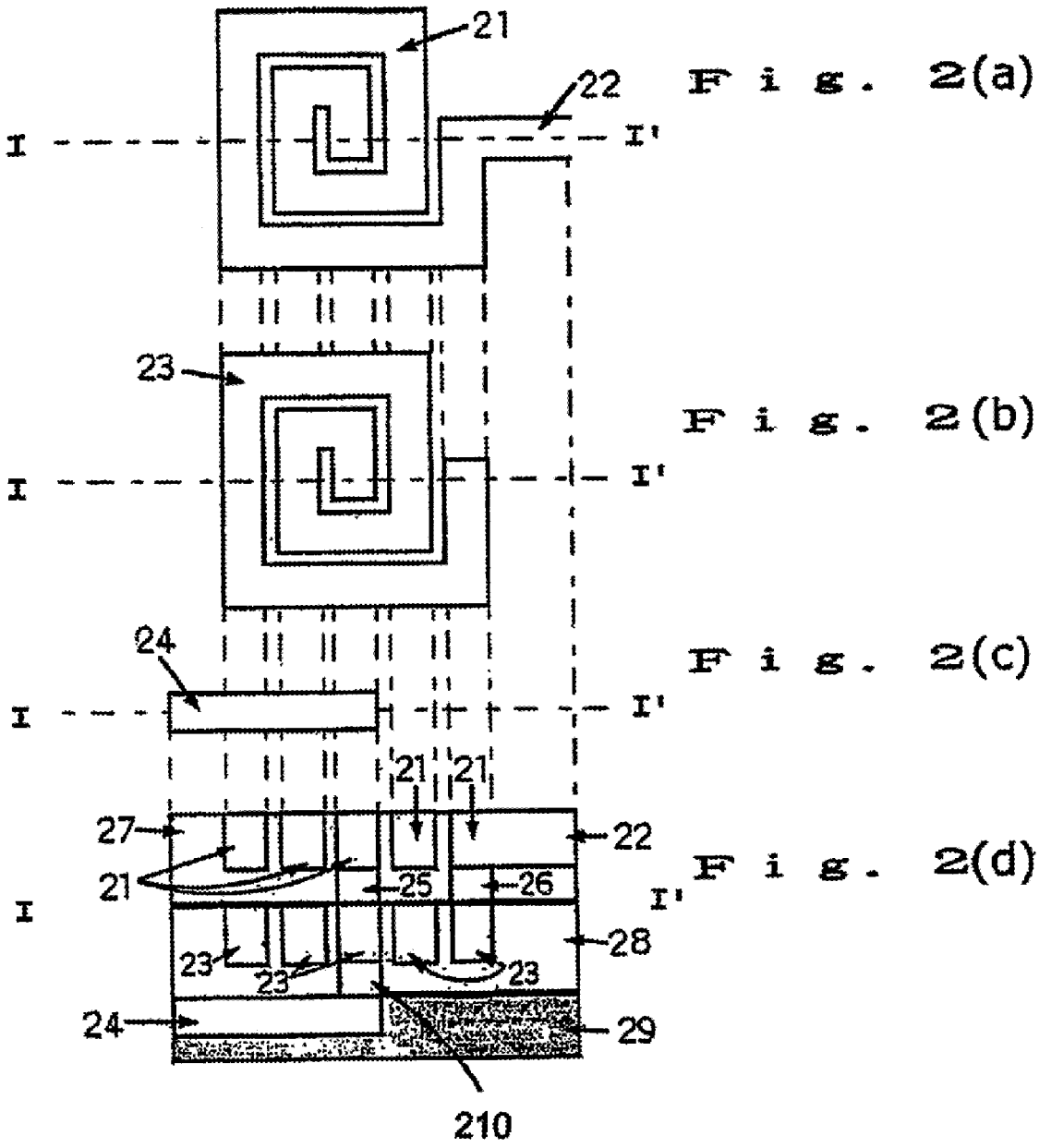
Figures 3A, 3B, 3C, 3D, 3E:
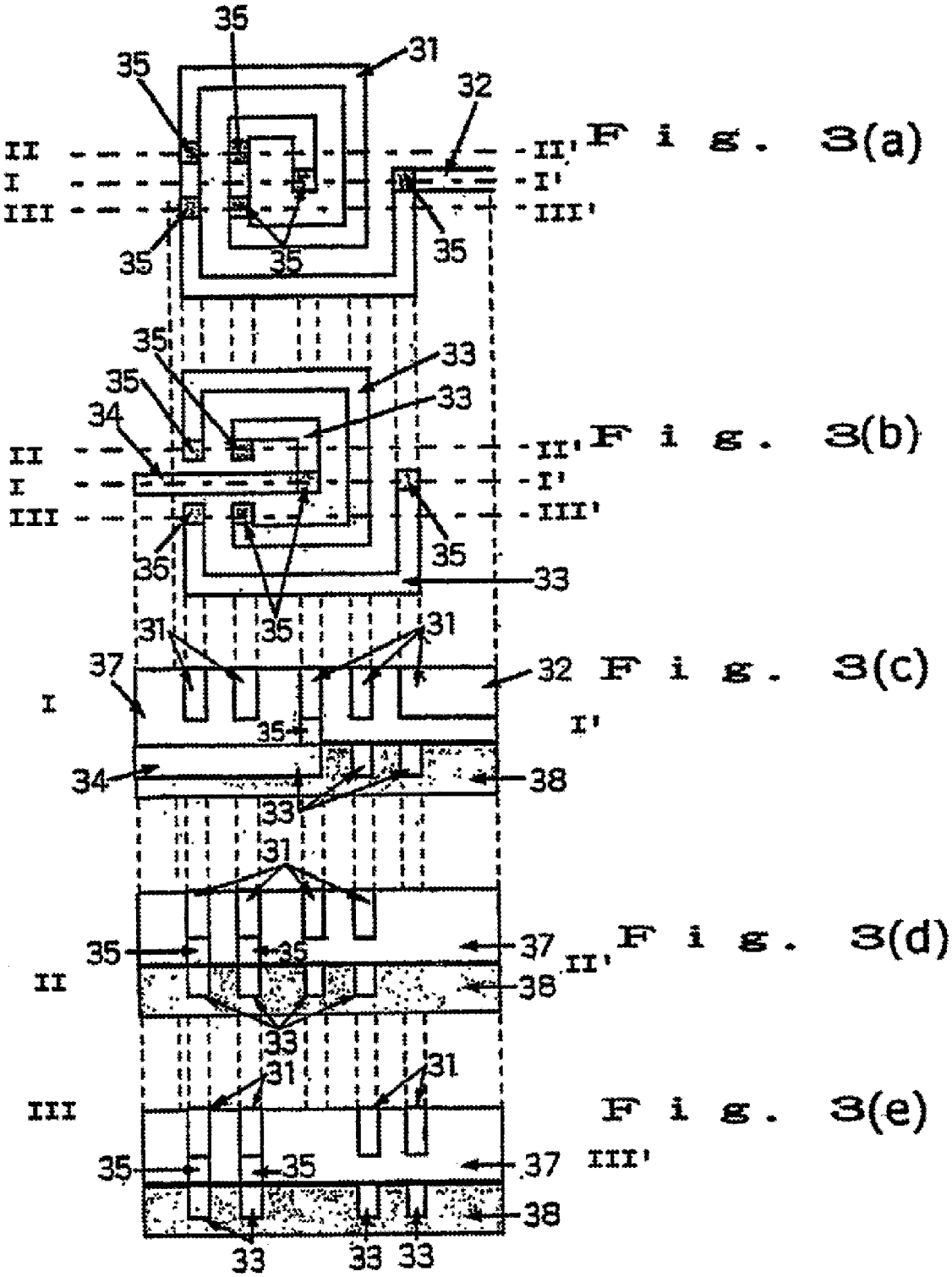
Figures 4A, 4B, 4C, 4D, 4E:
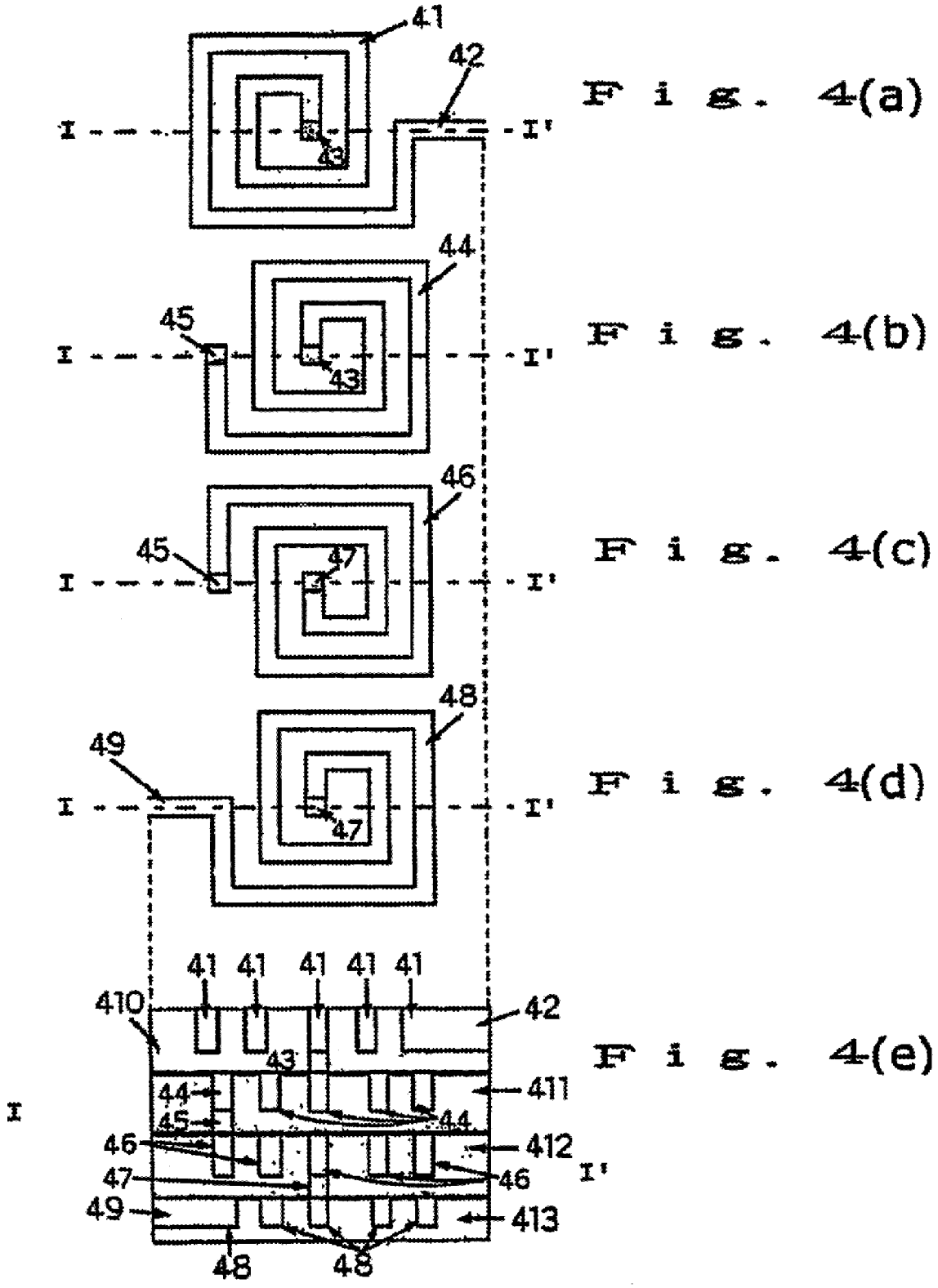
Figures 9A, 9B:
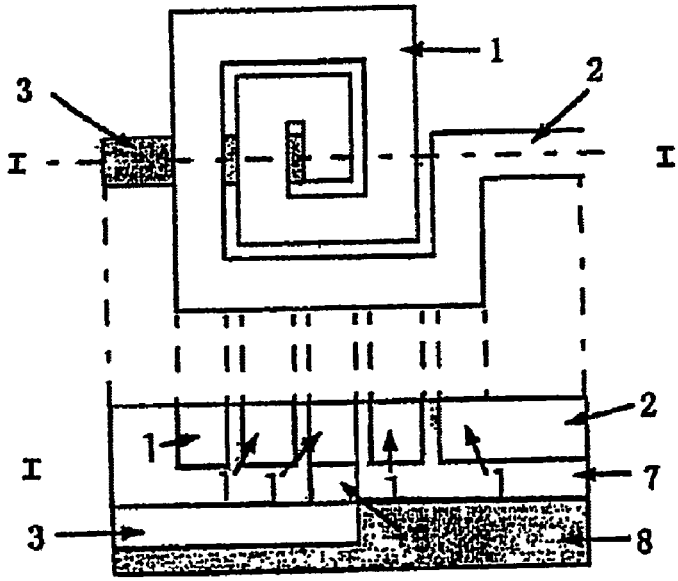
Fig. 9(a) PRIOR ART

FIGS. 7 and 8 are graphs showing comparison of performances of the two-layer inductor according to the present invention and a conventional one-layer inductor.

FIG. 7 is a graph obtained by plotting a variation of the resistance (R) with respect to the length (L). It is observed from this figure that R is smaller in the two-layer inductor according to the present invention.

FIG. 8 is a graph obtained by plotting a variation of the Q value (Q) with respect to the length (L). It is observed from this figure that Q is greater in the two-layer inductor according to the present invention.

(embodiment 4)

Figure 4:
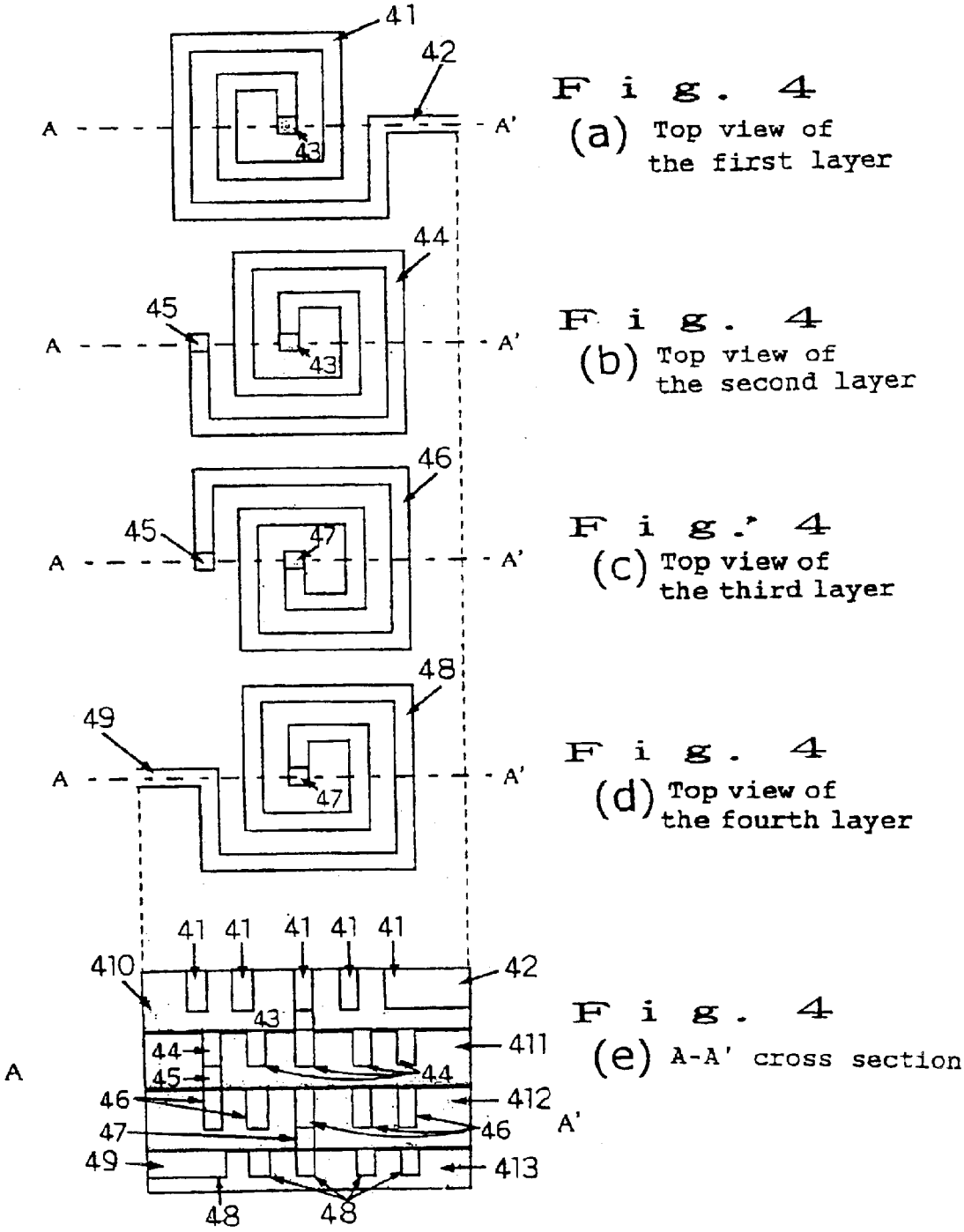
FIG. 4 shows an inductor of Embodiment 4 of the present invention, illustrating a top view of the first, second, third and fourth layers and an I–I' cross-section, respectively, as FIGS. 4(*a*), 4(*b*), 4(*c*), 4(*d*) and 4(*e*)

FIG. 4 shows the fourth embodiment of the high-Q inductor for high frequency according to the present invention. Referring to FIG. 4, the reference numeral 41 denotes a spiral-shaped first-layer inductor section, 42 denotes a first-layer drawing interconnect, 43 denotes a connection between the first and second layers, 44 denotes a spiral-shaped second-layer inductor section, 45 denotes a connection between the second and third layers, 46 denotes a spiral-shaped third-layer inductor section, 47 denotes a connection between the third and fourth layers, 48 denotes a spiral-shaped fourth-layer inductor section, 49 denotes a fourth-layer drawing interconnect, 410, 411, and 412 denote interlayer films, and 413 denotes a smoothing film.

In this embodiment, the adjacent inductor sections are connected with each other. Specifically, the centers or the outer ends of the adjacent inductor sections are connected with each other. These inductor sections are therefore connected in series with each other.

Adjacent inductor sections also overlap one another. Where they overlap can be referred to as a first area. This first area is smaller than a second area defined by the overlap between non-adjacent inductor sections. For example, the (first) area defined by the overlap of adjacent inductor sections 44 in FIG. 4(*b*) and 41 in FIG. 4(*a*) (or 46 in FIG. 4(*a*)) is smaller than the (second) area defined by the overlap or projection of inductor section 48 of FIG. 4(*d*) on section 44.

In this embodiment, the second-layer and fourth-layer inductor sections have a shape inverted upside down from that of the first-layer and third-layer inductor sections. By this arrangement, the directions of the magnetic fields generated by the respective inductor sections are the same, resulting in effective coupling.

In the conventional structure where the inductor section is constructed using only a single layer, when the entire length of the inductor section is increased to obtain a high Q value, the size of the inductor section also increases. On the contrary, in Embodiment 4, since the length of the inductor sections is increased stereoscopically as a whole, the resultant size is compact.

Figure 5:
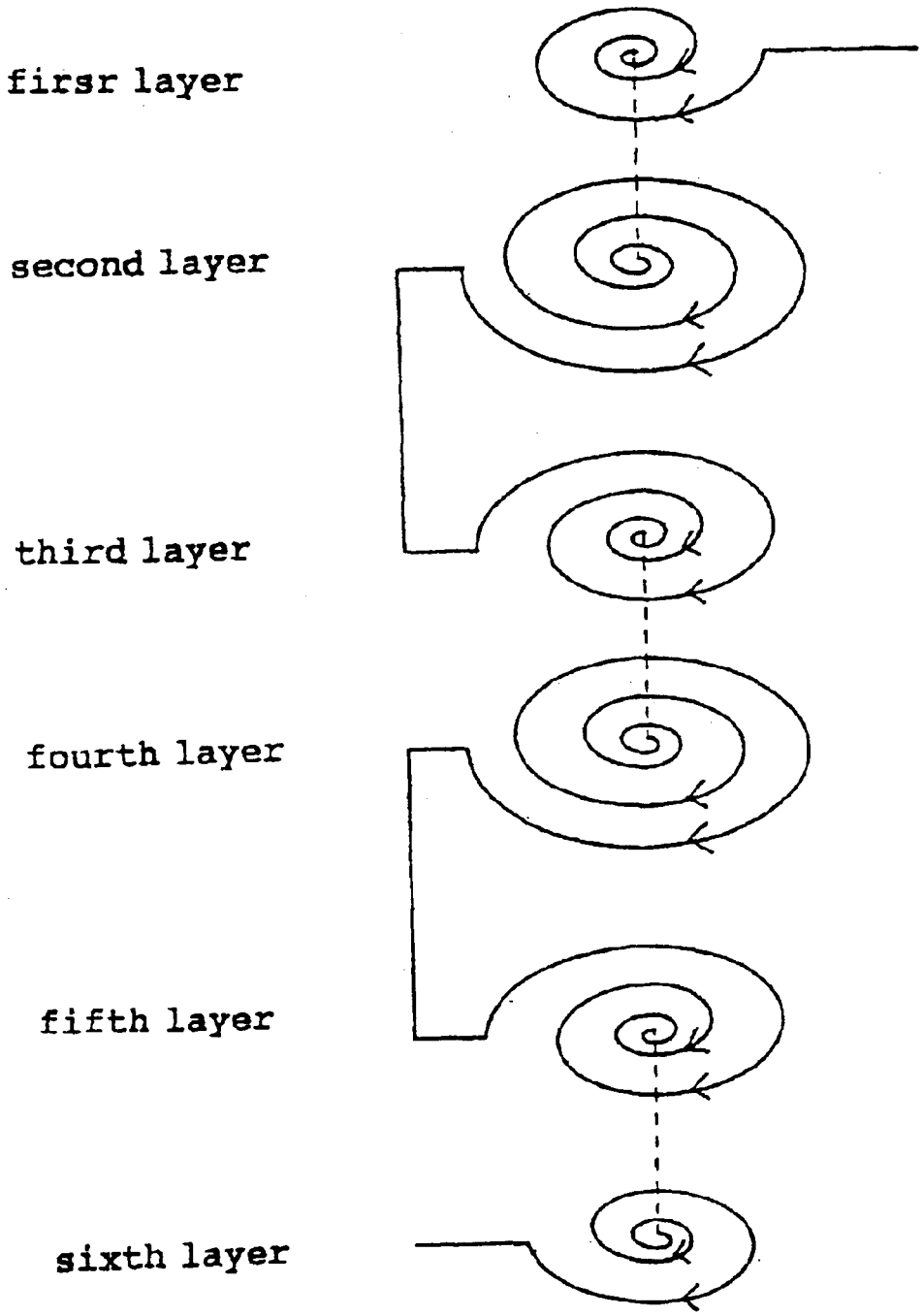
FIG. 5 is a schematic view illustrating another inductor according to the present invention.

The four-layer structure was described in this embodiment. However, as shown in FIG. 5, the number of layers may be increased to five or six, for example, in a similar structure. The structure is simpler when the number of layers is even, because the drawing interconnect can be formed to be connected with the outer end of the bottom inductor section.

When the number of layers is odd, the drawing interconnect can be arranged in a manner described in FIG. 2 or 3.

Figure 6:
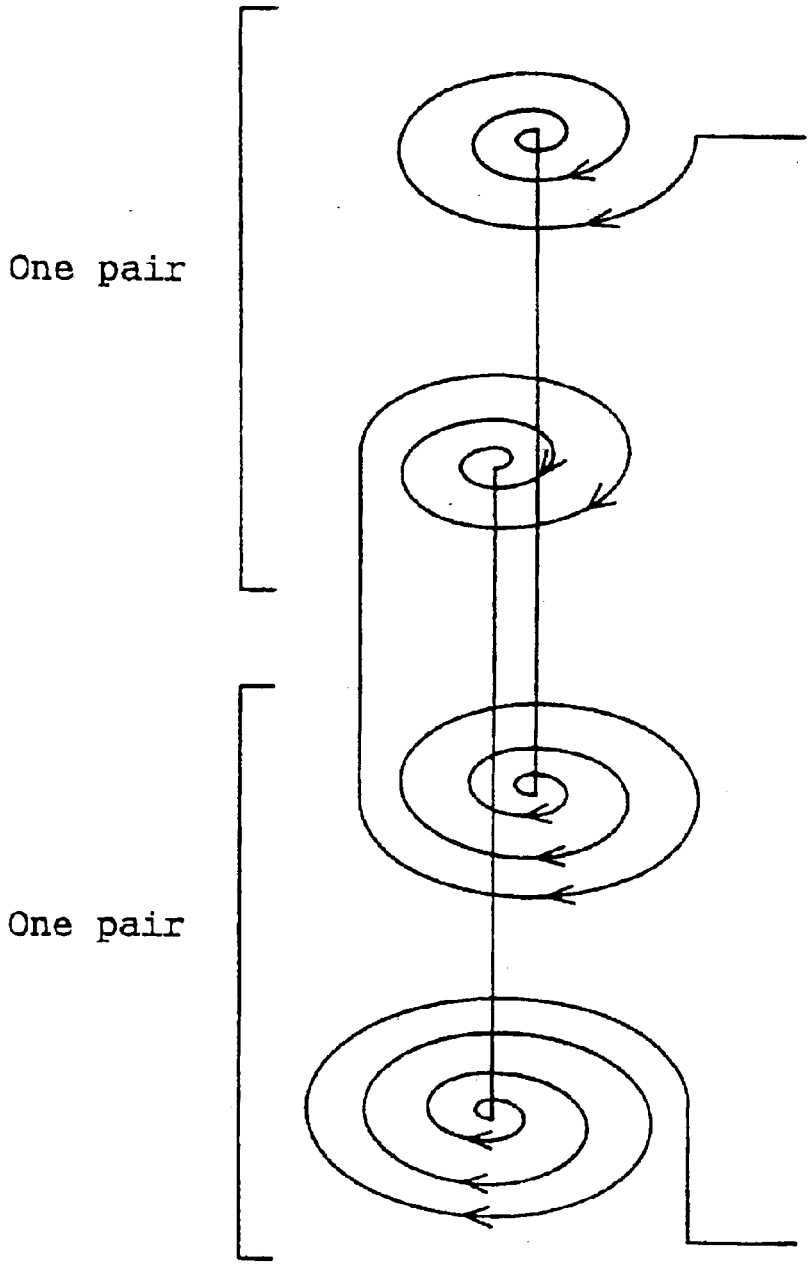
FIG. 6 is a schematic view illustrating yet another inductor according to the present invention.

Alternatively, as shown in FIG. 6, a pair of adjacent inductor sectors may have the same spiral direction, and adjacent pairs of adjacent inductor sectors may have different spiral directions. In this case, one inductor sector of one pair is connected with one of another pair as shown in FIG. 6 so that all the inductor sectors are serially connected.

In the above case, also, the directions of the magnetic fields generated by the respective inductor sectors are the same, resulting in effective coupling.

Thus, according to the present invention, the inductor section, which is conventionally constructed of a single wiring layer, is of a multi-layer structure. As a result, a high Q-value inductor which has a reduced serial resistance component and is free from an influence of a skin effect can be fabricated in an IC.

Many modifications and variations of the present invention will be apparent to those skilled in the art without departing from the scope and spirit of the invention. It should therefore be understood that the present invention is not limited to the specific embodiments illustrated herein but only defined by the appended claims.

What is claimed is:

1. A high-Q inductor for high frequency, comprising a plurality of inductor elements formed in a plurality of IC wiring layers respectively, wherein the plurality of inductor elements are formed in a spiral shape respectively, each said spiral shape being constructed from a combination of plural pairs of straight and parallel lines, wherein adjacent inductor elements of the plurality of inductor elements are connected with each other in such manner that the adjacent inductor elements are serially connected by connecting the spiral centers thereof with each other and outer ends thereof with each other, wherein a first area in which one spiral shape overlaps with an adjacent spiral shape is smaller than a second area in which said one spiral shape overlaps with a non-adjacent spiral shape, and wherein spiral directions of the adjacent inductor elements are in reverse from each other, so that directions of the magnetic fields generated by the respective inductor elements are substantially the same.

* * * * *

UNITED STATES PATENT AND TRADEMARK OFFICE

CERTIFICATE OF CORRECTION

PATENT NO. : 6,891,462 B2
APPLICATION NO. : 10/667386
DATED : May 10, 2005
INVENTOR(S) : Andoh et al.

It is certified that error appears in the above-identified patent and that said Letters Patent is hereby corrected as shown below:

The title page showing the illustrative figure should be deleted to be replaced with the attached title page.

The drawing sheet, consisting of Figs. 4a-4e, should be deleted to be replaced with drawing sheet, consisting of Figs. 4a-4e, as shown on the attached page.

Title Page

In the title page, in Field 56, under the heading U.S. PATENT DOCUMENTS, please add --4,873,757 10/1989 Williams--.

Drawings

Replace drawings sheets 1, 2, 3, 4, and 9 with the drawing sheets shown on the attached pages.

Signed and Sealed this

Twelfth Day of December, 2006

JON W. DUDAS
*Director of the United States Patent and Trademark Office*

(12) United States Patent
Andoh et al.

(10) Patent No.: US 6,891,462 B2
(45) Date of Patent: May 10, 2005

(54) HIGH-Q INDUCTOR FOR HIGH FREQUENCY

(75) Inventors: Toshiakira Andoh, Katano (JP); Makoto Sakakura, Uji (JP); Toshifumi Nakatani, Moriguchi (JP); Kouji Takinami, Katano (JP); Yukio Hiraoka, Nishinomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/667,386

(22) Filed: Sep. 23, 2003

(65) Prior Publication Data

US 2004/0041680 A1 Mar. 4, 2004

Related U.S. Application Data

(62) Division of application No. 10/043,222, filed on Jan. 14, 2002, now Pat. No. 6,664,882, which is a division of application No. 09/454,610, filed on Dec. 7, 1999, now abandoned.

(30) Foreign Application Priority Data

Dec. 11, 1998 (JP) ..... H10-353078

(51) Int. Cl.[7] ..... H01F 5/00
(52) U.S. Cl. ..... 336/200; 336/232; 336/223
(58) Field of Search ..... 336/200, 232, 336/223

(56) References Cited

U.S. PATENT DOCUMENTS

| | | | | |
|---|---|---|---|---|
| 3,798,059 A | | 3/1974 | Astle et al. | |
| 4,494,100 A | | 1/1985 | Stengel et al. | |
| 4,583,099 A | | 4/1986 | Reilly et al. | |
| 4,626,816 A | * | 12/1986 | Blumkin et al. | 336/192 |
| 4,641,118 A | | 2/1987 | Hirose et al. | |
| 5,382,829 A | * | 1/1995 | Inoue | 257/659 |
| 5,398,400 A | * | 3/1995 | Breen | 29/602.1 |
| 5,497,337 A | | 3/1996 | Ponnapalli et al. | |
| 5,656,849 A | | 8/1997 | Burghartz et al. | |
| 6,037,649 A | | 3/2000 | Liou | |
| 6,136,458 A | | 10/2000 | Inoue | |
| 6,268,778 B1 | | 7/2001 | Mucke et al. | |
| 6,355,535 B2 | | 3/2002 | Liou | |
| 6,366,192 B2 | * | 4/2002 | Person et al. | 336/200 |
| 6,426,267 B2 | | 7/2002 | Liou | |

FOREIGN PATENT DOCUMENTS

| | | | |
|---|---|---|---|
| EP | 0484558 | 12/1991 | |
| JP | 409270332 A | 1/1997 | |
| WO | WO 91/19303 | 12/1991 | |
| WO | WO 9119303 A1 * | 12/1991 | H01F/17/00 |

OTHER PUBLICATIONS

Article Entitled "Design and Simulation of Film Transformer on Flexible Polyamide Film in Very High Frequency Range" by H. Tsujimoto, IEEE Transaction on Magnetics, vol. No. 4, Jul. 1998.

H. Tsujimoto, "Design and Simulation of Film Transformer on Flexible Polyamide Film in Very High Frequency Range", IEEE Transactions on Magnetics, vol. 34, No. 4, Jul. 1998, pp. 1357–1359.

* cited by examiner

*Primary Examiner*—Anh Mai
(74) *Attorney, Agent, or Firm*—Smith, Gambrell & Russell, LLP

(57) ABSTRACT

A high-Q inductor for high frequency, having a plurality of inductor elements formed in a plurality of IC wiring layers with a connection formed therebetween. The directions of the magnetic fields generated by the respective inductor elements are substantially the same. With this construction, the section of the inductor is increased reducing the serial resistance component and an influence of a skin effect in a high-frequency range is eliminated increasing the Q value.

1 Claim, 9 Drawing Sheets

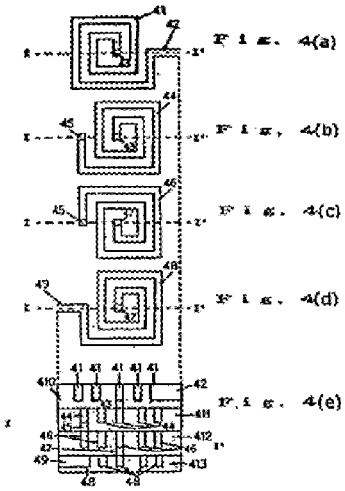

PRIOR ART